US005960756A

United States Patent [19]

Miyachi et al.

[11] Patent Number: 5,960,756

[45] Date of Patent: Oct. 5, 1999

[54] VALVE CONTROL DEVICE FOR AN INTERNAL COMBUSTION ENGINE

[75] Inventors: Eiji Miyachi, Nukata-gun; Hisashi Kodama, Nagoya; Yosuke Tateishi, Anjo, all of Japan

[73] Assignee: Aisin Seiki Kabushiki Kaisha, Aichi-pref., Japan

[21] Appl. No.: 09/014,101

[22] Filed: Jan. 27, 1998

[30] Foreign Application Priority Data

Jan. 27, 1997 [JP] Japan ..... 9-028361
Mar. 25, 1997 [JP] Japan ..... 9-072060

[51] Int. Cl.[6] ..... F01L 13/00

[52] U.S. Cl. ..... 123/90.16; 123/90.22; 123/90.4; 123/90.43

[58] Field of Search ..... 123/90.15, 90.16, 123/90.17, 90.22, 90.27, 90.39, 90.4, 90.41, 90.43, 90.46

[56] References Cited

U.S. PATENT DOCUMENTS 5,419,290 5/1995 Hurr et al. ..... 123/90.16
5,501,186 3/1996 Hara et al. ..... 123/90.17
5,613,469 3/1997 Rygiel ..... 123/90.16
5,685,264 11/1997 Allen et al. ..... 123/90.16
5,785,017 7/1998 Saito et al. ..... 123/90.16

FOREIGN PATENT DOCUMENTS 6-317128 11/1994 Japan .
7-286506 10/1995 Japan .

*Primary Examiner*—Weilun Lo
*Attorney, Agent, or Firm*—Hazel & Thomas, P.C.

[57] ABSTRACT

A valve control device for an internal combustion engine includes a rotational cam shaft disposed on a cylinder head, a first cam provided on the cam shaft, a second cam provided on the cam shaft and having a larger nose portion than that of the first cam, a first rocker arm supported on a first fulcrum so as to be able to oscillate and thereby open or close an intake or exhaust valve by the first cam in response to the rotation of the cam shaft, a second rocker arm supported on a second fulcrum so as to be able to oscillate and thereby open or close an intake or exhaust valve by the second cam in response to the rotation of the cam shaft, and a moving mechanism for selectively moving the second fulcrum so as to control the opening and closing operation of the intake or exhaust valve by the second rocker arm.

7 Claims, 14 Drawing Sheets

VALVE CONTROL DEVICE FOR AN INTERNAL COMBUSTION ENGINE

BACKGROUND OF THE INVENTION

1. Field of the Invention

The present invention relates to a valve control device for an internal combustion engine.

2. Description of the Prior Art

A conventional valve control device is disclosed, for example, in Japanese Patent laid-open publication No. 7 (1995) -286506. This conventional device includes a rotational cam shaft which is rotatably supported on a cylinder head, a first cam provided on the cam shaft, a second cam provided on the cam shaft and having a larger nose portion than that of the first cam, a rocker shaft which is supported on the cylinder head, a first rocker arm which is rotatably supported on the rocker shaft and which is oscillated round the rocker shaft in response to the first cam so as to open and close an intake or exhaust valve, a second rocker arm which is rotatably supported on the rocker shaft and which is oscillated round the rocker shaft in response to the second cam and connecting means for selectively connecting the second rocker arm to the first rocker arm.

In this device, when the first rocker arm is not connected to the second rocker arm, a lift characteristic of the intake or exhaust valve determined by the first cam is obtained. On the other hand, when the first rocker arm is connected to the second rocker arm, a lift characteristic of the intake or exhaust valve determined by the second cam is obtained. When the first rocker arm is not connected to the second rocker arm, the second rocker arm makes a lost motion.

In the above prior device, however, a lifter which is disposed on the cylinder head is additionally required only for ensuring such lost motion of the second rocker arm. Therefore, the number of the component parts of the valve timing control device is increased and the manufacturing cost thereof is also increased.

SUMMARY OF THE INVENTION

It is, therefore, an object of the present invention to provide an improved valve control device for an internal combustion engine, which overcomes the above drawbacks.

It is another object of the present invention to provide an improved valve control device for an internal combustion engine, which can reduce the number of the component parts thereof.

In order to achieve these objectives, there is provided an improved valve control device for an internal combustion engine, which includes a rotational cam shaft disposed on a cylinder head, a first cam provided on the cam shaft, a second cam provided on the cam shaft and having a larger nose portion than that of the first cam, a first rocker arm supported on a first fulcrum so as to be able to oscillate, and thereby open and close an intake or exhaust valve by the first cam in response to the rotation of the cam shaft, a second rocker arm supported on a second fulcrum so as to be able to oscillate and thereby open and close an intake or exhaust valve by the second cam in response to the rotation of the cam shaft and moving means for selectively moving the second fulcrum so as to control the opening and closing operation of the intake or exhaust valve by the second rocker arm.

BRIEF DESCRIPTION OF THE DRAWINGS

Additional objects and advantages of the present invention will become more apparent from the following detailed description of preferred embodiments thereof when considered with reference to the attached drawings, in which.

DESCRIPTION OF THE PREFERRED EMBODIMENTS

A valve control device in accordance with preferred embodiments of the present invention will be described with reference to attached drawings.

Figure 1:
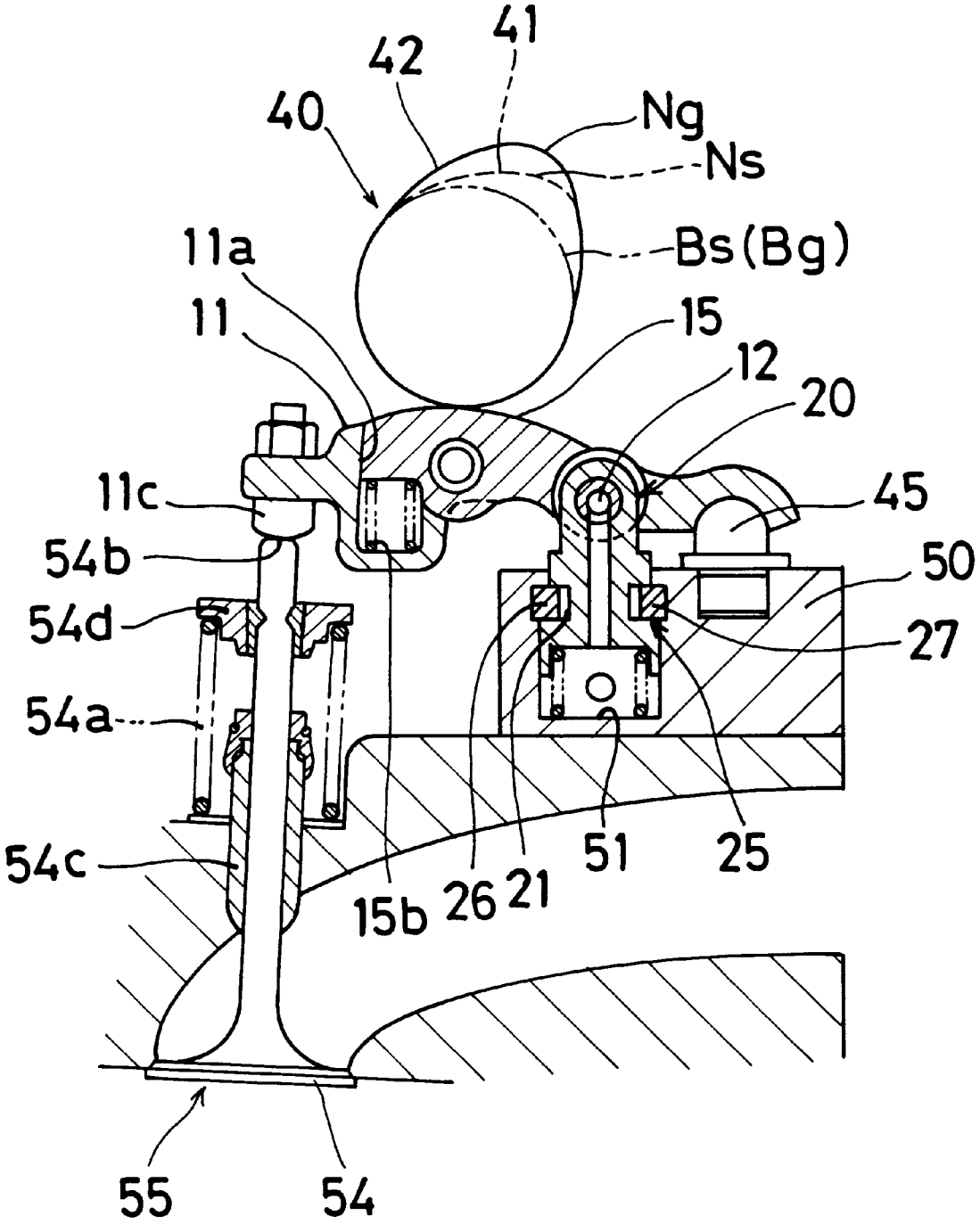
FIG. 1 shows a sectional view of a first embodiment of a valve control device under which a second fulcrum is not movable and which base circle portions of the first and second cam contact with the first and second rocker arms, in accordance with the present invention.
Figure 2:
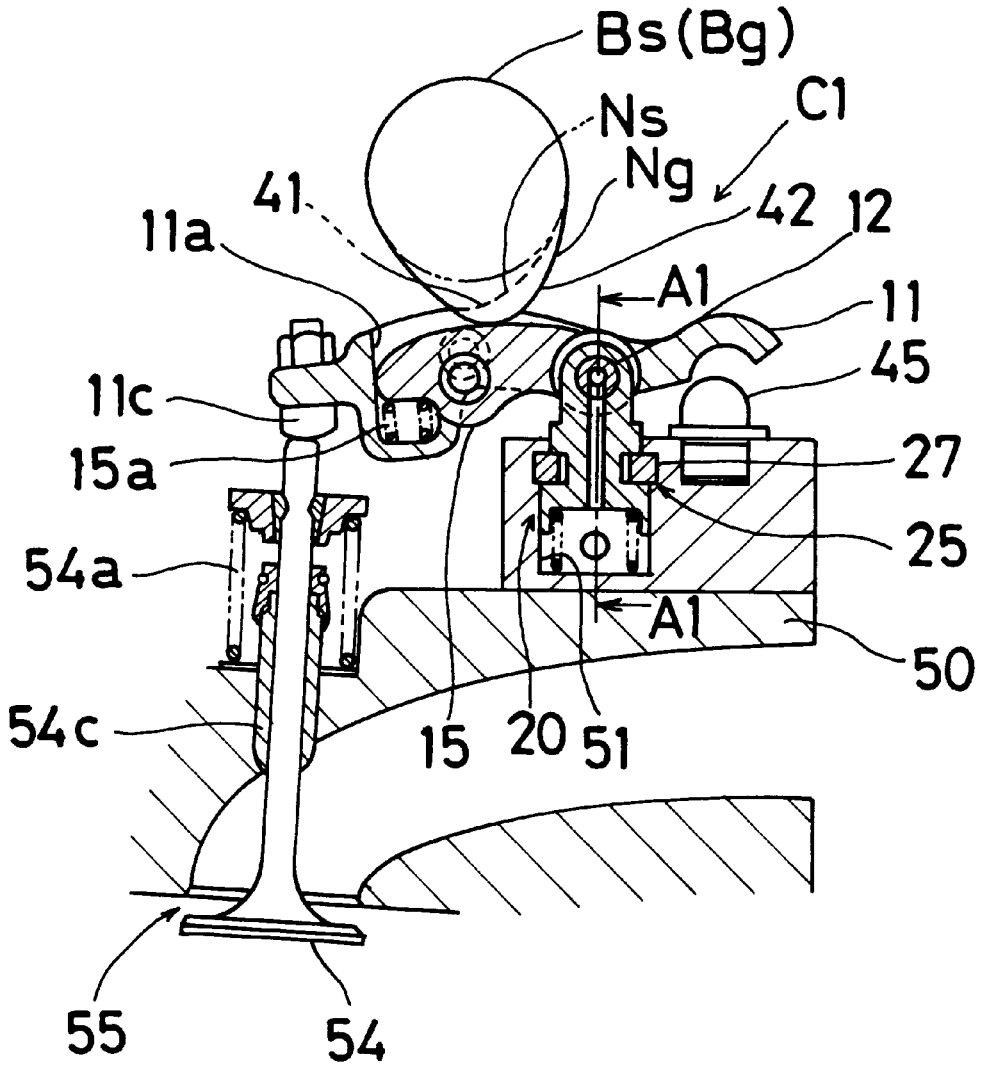
FIG. 2 shows a sectional view of a first embodiment of a valve control device under which the second fulcrum is not movable and which the operative connection between the first and second rocker arm is released, in accordance with the present invention.
Figure 3:
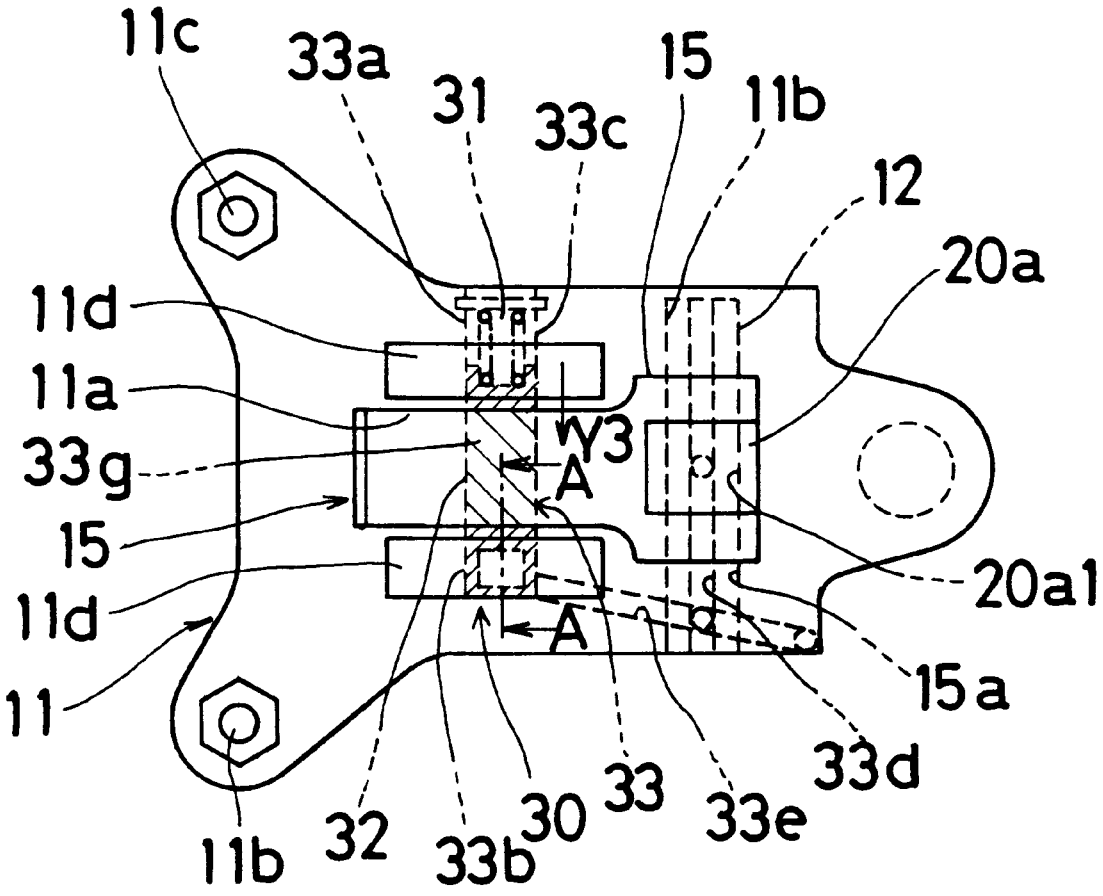
FIG. 3 shows a plan view of the first and second rocker arms in FIG. 2 and shows a side view as seen from a direction indicated by an arrow C1 of FIG. 2.
Figure 6:
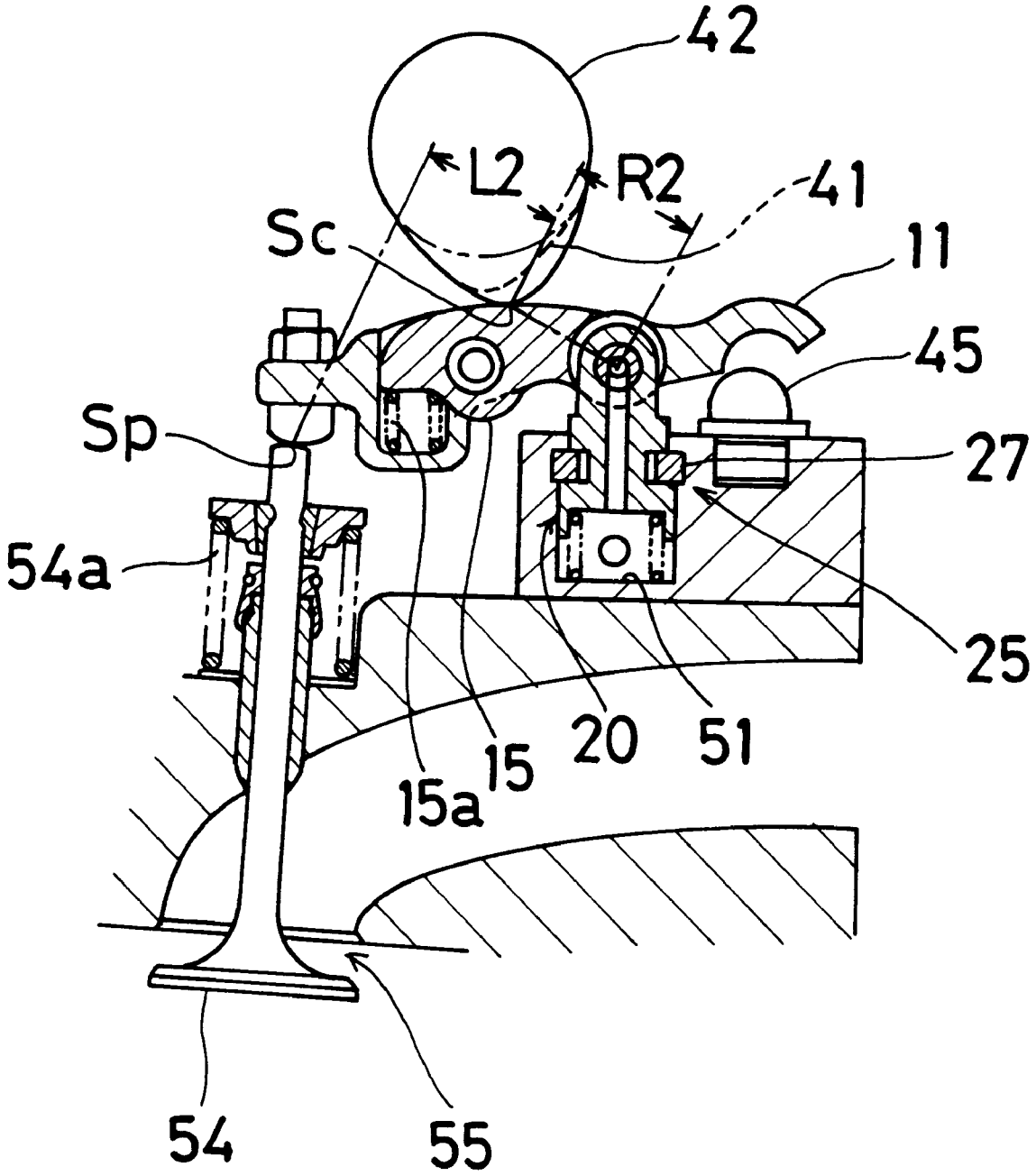
FIG. 6 shows a sectional view of a first embodiment of a valve control device under which the second fulcrum is not movable and which the operative connection between the first and second rocker arms is maintained, in accordance with the present invention.
Figure 7:
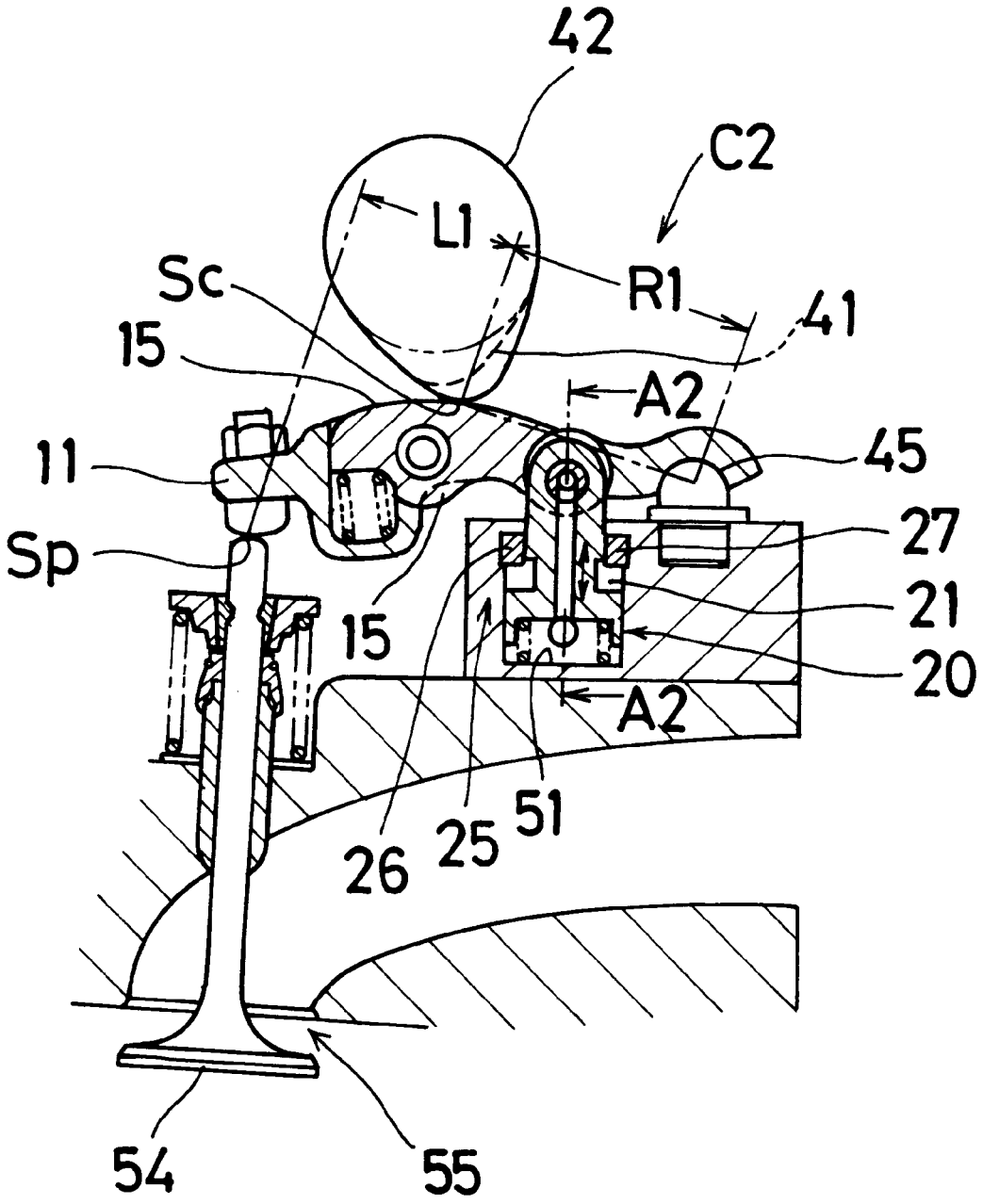
FIG. 7 shows sectional view of a first embodiment of a valve control device under which the second fulcrum is movable and which the operative connection between the first and second rocker arms is maintained, in accordance with the present invention.
Figure 8:
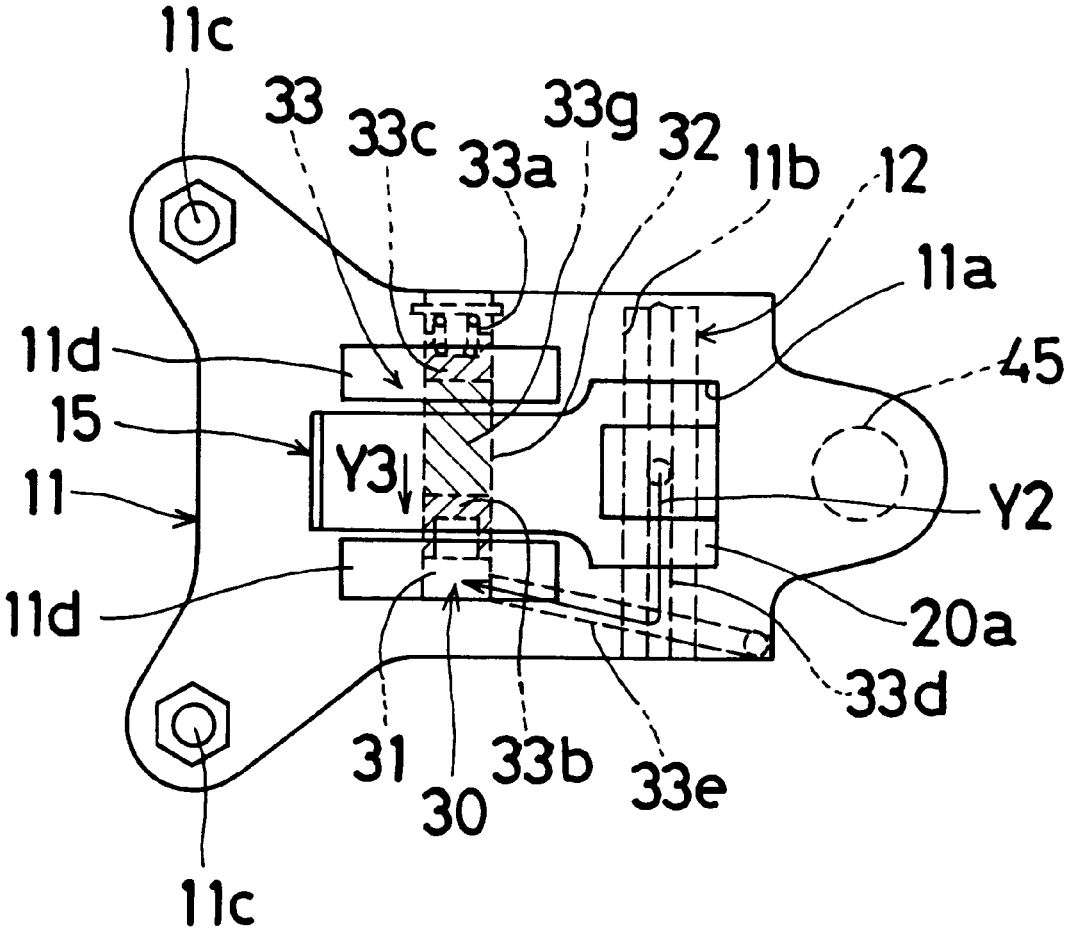
FIG. 8 shows a plan view of the first and second rocker arms in FIG. 7 and shows a side view as seen from a direction indicated by an arrow C2 of FIG. 7.

FIGS. 1 through 12 show a first embodiment of a valve control device for an internal combustion engine according to the present invention. Referring to FIG. 1, the valve control device, which is designed for opening and closing a pair of intake (or exhaust) valves 54, has a rotational cam shaft 40 rotatably supported on a cylinder head 50, a first rocker arm 11 supported on an arm shaft 12 so as to be able to oscillate, a second rocker arm 15 supported on the arm shaft 12 so as to be able to oscillate, a first cam 41 provided on the cam shaft 40 and having a nose portion N*s* and a base circle portion B*s*, a second cam 42 provided on the cam shaft 40 and having a nose portion N*g* and a base circle portion Bg and a holding member 20 disposed on the cylinder head 50 so as to be selectively vertically movable relative to the cylinder head 50 and supporting the arm shaft 12. The nose portion N*g* is larger than the nose portion N*s* and the base circle portion B*s* has the same diameter as the base portion B*g*. The holding member 20 functions as a first fulcrum portion for the first rocker arm 11 as well as a second fulcrum portion for the second rocker arm 15. The first cam 41 normally contacts with the first rocker arm 11 and the second cam 42 normally contacts with the second rocker arm 15. A swing end of the second rocker arm 15 is operatively connected to the first rocker arm 11. Further, the valve control device has moving means 25 for selectively moving the holding member 20 in response to hydraulic pressure from hydraulic pressure control means (not shown) and a fulcrum member 45 (a third fulcrum portion) which supports the base end of the first rocker arm 11 when the holding member 20 is moved by the moving means 25. The valve control device further includes release means 30 for selectively releasing the connection between the first and second rocker arms 11, 15 in response to the hydraulic pressure from the hydraulic pressure control means as shown in FIGS. 3 and 8.

The valve control device realizes a high lift characteristic by connecting between the first and second arms 11, 15 as shown in FIGS. 6 and 7 or by immobilizing the holding member 20 relative to the cylinder head 50 as shown in FIGS. 1, 2 and 6 as explained later.

The holding member 20 has a stopped cylindrical configuration and is slidably fitted into a receiving hole 51 which is formed on the cylinder head 50. The moving means 25 includes a concave portion 26 (FIGS. 4 and 5) which is formed on the cylinder head 50 so as to open into the receiving hole 51 and which extends so as to intersect at right angles with regard to the axial direction of the receiving hole 51, a circular groove 21 which is formed on a stopped portion of the holding member 20, and a plat member 27 which is slidably fitted into the concave portion 26 and the circular groove 21. The plate member 27 selectively engages with the circular groove 21 in response to its sliding movement so that the holding member 20 immobilizes relative to the cylinder head 50. The plate member selectively disengages from the circular groove 21 so that the holding member 20 can move relative to the cylinder head 50.

The first and second rocker arms 11 and 15 have first and second engaging holes 31, 32, respectively. The engaging holes 31, 32 are coaxially positioned with each other under which the base circle portions B*s*, B*g* contact with the first and second rocker arms 11, 15 (FIGS. 3 and 8). The release means 30 includes an engaging member 33 (a first part 33*g*, a second part 33*c* and a third part 33*b*) which is slidably fitted into the engaging holes 31, 32. When the engaging member 33 is engaged with the engaging holes 31, 32 as shown in FIG. 8, the second rocker arm 15 is operatively connected to the first rocker arm 11. When the engaging member 33 is disengaged from the second engaging hole 32, the connection between the first and second rocker arms 11, 15 is released.

As shown in FIG. 1, the intake valve 54*a* is normally urged toward the closed position by a valve spring 54*a*. In FIG. 1, numerals 54*c*, 54*d* indicate a valve guide and a retainer. A stem end 54*b* of the intake valve 54 contacts with an adjusting screw 11*c* which is provided on a swing end of the first rocker arm 11. Thereby, the intake valve 54 moves up and down in response to the oscillating motion of the first rocker arm 11 and opens and closes an intake port 55.

At a near center of the first rocker arm 11, as shown in FIGS. 3 and 8, a T-shaped receiving hole 11*a* extends in the longitudinal direction of the first rocker arm 11. The receiving hole 11*a* penetrates the first rocker arm 11 except for its portion which is located at the side of the swing end of the first rocker arm 11. A hole 11*b* is formed on the first rocker arm 11 so as to intersect at right angles relative to the longitudinal direction of the first rocker arm 11. The hole 11*b* is opened into the receiving hole 11*a* which is located at the side of the base end of the first rocker arm 11. The second rocker arm 15 which is nearly Y-shaped is disposed in the receiving hole 11*a*.

A hole 15*a* which is coaxial with the hole 11*b* is formed on the second rocker arm 15 which is located at the side of the base end of the first rocker arm 11. The arm shaft 12 is fitted into the holes 11*b* and 15*a*. Thereby, the first and second rocker arms 11, 15 are supported on the arm shaft 12 so as to be able to oscillate. As shown in FIGS. 1 and 2, a spring 15*b* is disposed between the bottom portion of the receiving hole 11*a* and the swing end of the second rocker arm 15. Thereby, the second rocker arm 15 is normally urged clockwise so that a cam follower portion formed on the swing end is normally contacted with the second cam 42. On a part of the first rocker arm 11 which is in the same position as the cam follower portion of the second rocker arm 15 in the longitudinal direction of the first rocker arm 11, cam follower portions 11*d* (FIGS. 3 and 8) which is opposite to the first cam 41 are formed thereon.

As shown in FIGS. 3 and 8, on the part of the first rocker arm 11 on which the cam follower portions 11*d* are formed, a pair of first engaging holes 31 which extend so as to intersect at right angles relative to the longitudinal direction of the first rocker arm 11 are formed. Further, on the part of the second rocker arm 15 on which the cam follower portion is formed, the second engaging hole 32 whose diameter is the same as that of the first engaging hole 31 and which extends so as to intersect at right angles relative to the longitudinal direction of the first rocker arm 11 are formed. These first and second engaging holes 31, 32 are coaxial with each other when the first and second rocker arms 11, 15 contact with the bass circle portions of the first and second cam 41, 42, respectively.

Figure 12:
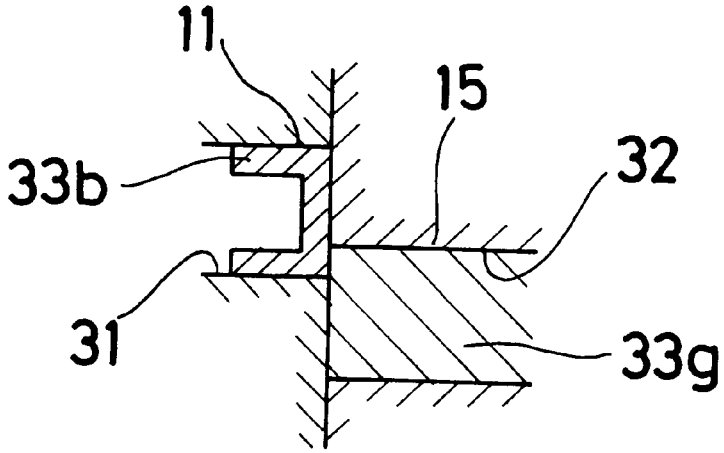
FIG. 12 shows a cross-sectional view taken on line A—A of FIG. 3.

The engaging member 33 is disposed in the first and second engaging holes 31, 32. The engaging member 33 includes the first part 33*g* whose axial length is the same as that of the second engaging hole 32 and which is slidably fitted into the second engaging hole 32, the second part 33*c* which is normally urged in a direction of an arrow Y3 (FIGS. 3 and 8) by a spring 33*a* disposed in one of the first engaging holes 31 and whose one end is normally in contact with one end of the first part 33*g* and the third part 33*b* which is slidably fitted in the other of the first engaging holes 31 and whose one end is normally contacted with the other and of the first part 33*g* by the spring 33*a*. The third part 33*b* can be moved toward the second engaging hole 32 against the urging force of the spring 33*a* when the hydraulic pressure is applied to the other end of the third part 33*b* by the hydraulic pressure control means (not shown). Thereby, the third part 33*b* is positioned so as to be fitted into the first and second engaging holes 31, 32 the first and second rocker arms 11, 15 are operatively connected. On the other hand, when hydraulic pressure is not applied to the other hand of the third part 33*b*, as shown in FIG. 3, the third part 33*b* is not projected into the second engaging hole 32 as well as the first part 33*g* is not projected into the first engaging hole 31. Thereby, the second rocker arm 15 can be moved relative to the first rocker arm 11 and the first rocker arm 11 is oscillated by the first cam 41. As shown in FIG. 12, each of the ends of the first part 33*g*, as well as each end of the second part 33*b* and one end of the third part 33*c* have a flat surface which is parallel to a plane intersecting at right angles with the axis of the arm shaft 12.

Figure 9:
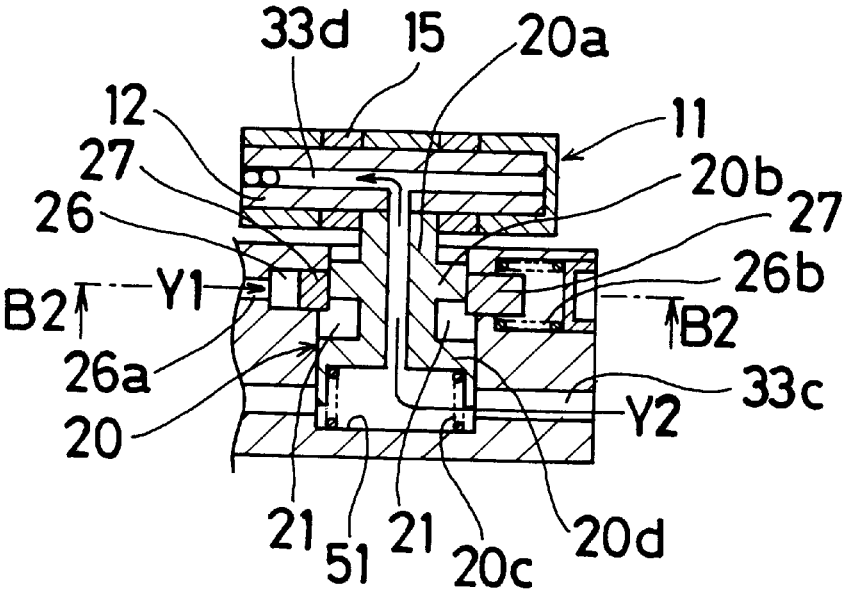
FIG. 9 shows a cross-sectional view taken on line A2—A2 of FIG. 7.

When the base circle portions B*s*, B*g* are in contact with the first and second rocker arms 11, 15 as shown in FIG. 1 and the first engaging holes 31 and the second engaging hole 32 are coaxial to each other, when the oil under pressure is applied to the other and of the third part 33*b* via oil passages 33*h*, 33*d* as indicated by an arrow Y2 in FIGS. 8 and 9, the third part 33*b* is projected into the second engaging hole 32 against the spring 33*a* and is fitted into the first and second engaging holes 31, 32. Simultaneously, the first part 33*g* is projected into the first engaging hole 31 against the spring 33*a* and is fitted into the first and second engaging holes 31, 32. Thereby, the second rocker arm 15 is operatively connected to the first rocker arm 11 so that both rocker arms 11, 15 are largely oscillated in a body by the second cam 42. Accordingly, the cam (the first and second cams 41, 42) for driving the first rocker arm 11 are changed by controlling the oil under pressure which is applied to the release means 30.

Figure 4:
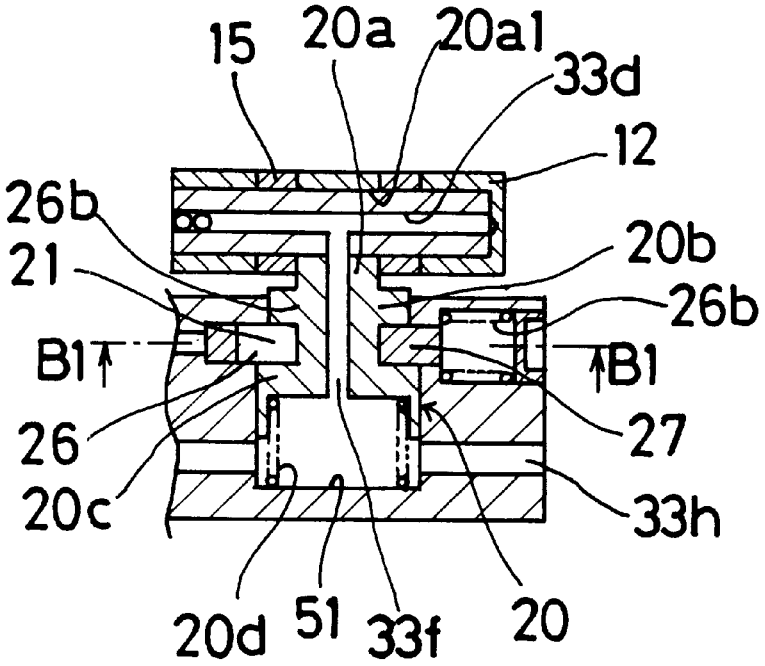
FIG. 4 shows a cross-sectional view taken on line A1—A1 of FIG. 2.

On the other hand, as shown in FIGS. 4 and 9, the holding member 20 includes a head portion 20*a*, a small-diameter portion 20*b* and a large-diameter portion 20*c*. The small-diameter portion 20*b* and the large-diameter portion 20*c* are slidably fitted into the receiving hole 51 having a stepped configuration. The circular groove 21 is formed on a part of the small diameter portion 20*b* which is adjacent to the large-diameter portion 20*c*. The head portion 20*a* is disposed between forked portions of the second rocker arm 15 and is provided with a hole 20*a*1 in which the arm shaft 12 is rotatably fitted. A spring 20*d* is disposed between the bottom of the receiving hole 51 and the large-diameter portion 20*c* and normally urges the holding member 20 toward the first and second rocker arms 11, 15. In the holding member 20, an oil passage 33*f* which is axially extended at the axial center is formed.

The oil passage 33*f* communicates with an oil passage 33*d* which is formed at the axial center of the arm shaft 12 and is simultaneously communicated to the oil passage 33*h* formed in the cylinder head 50. The supplying of the oil under pressure to the oil passage 33*h* is controlled by the hydraulic pressure control means. Further, as shown in FIGS. 3 and 8, the oil passage 33*d* communicates with the first engaging hole 31 via an oil passage 33*a* formed on the first rocker arm 11.

Figure 5:
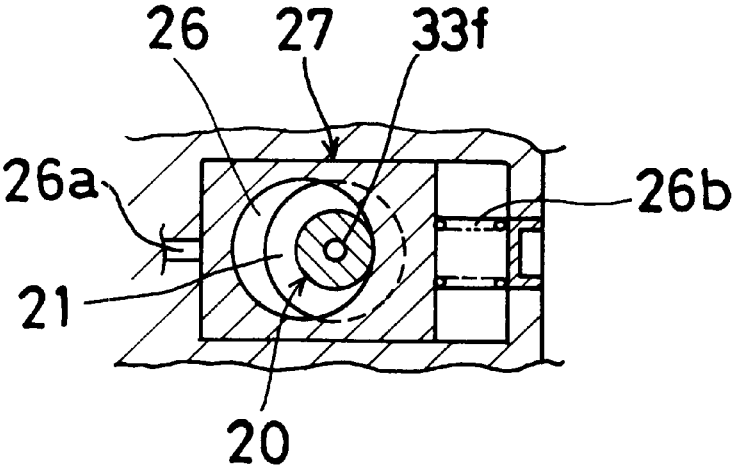
FIG. 5 shows a cross-sectional view taken on line B1—B1 of FIG. 4.

The plate member 27 is slidably fitted into the concave portion 26 which is formed on a part of a small-diameter portion of the receiving hole 51 adjacent its large-diameter portion. The plate member 27 is provided with a circular hole whose diameter is slightly larger than that of the small-diameter portion. A spring 26*b* is disposed in the concave portion 26 so as to normally urge the plate member 27 leftward in FIG. 5. Thereby, the plate member 27 is fitted into the circular groove 21 and the plate member 27 is engaged with the holding member 20 so that the holding member 20 immobilizes relative to the cylinder head 50 as shown in FIGS. 4 and 5. Thereby, the arm shaft 12 is not movable relative to the cylinder head 50 and the first and second rocker arms 11, 15 are oscillated around the secured arm shaft 12.

Under this condition, the distance R2 between the fulcrum (the arm shaft 12) and the contacting point S*c* of the second rocker arm 15 (or the first rocker arm 11) in contact with the second cam 42 (or the first cam 41) becomes small as shown in FIG. 6. As a result, a swing stroke of the contacting point S*p* of the first rocker arm 11 which contacts with the stem end of the intake valve S4 becomes large.

Figure 10:
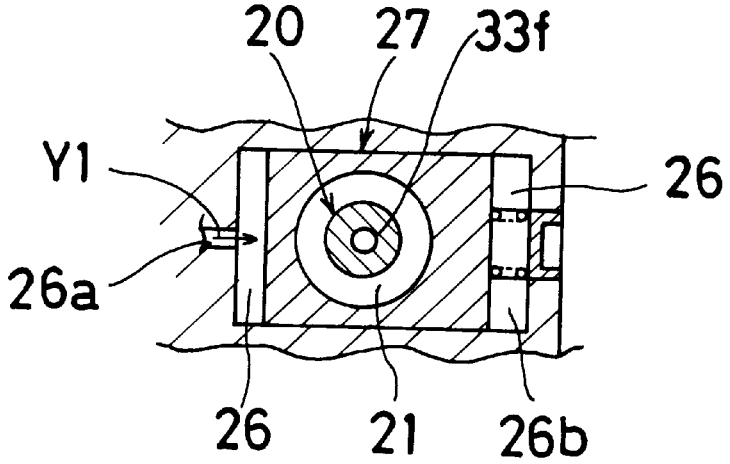
FIG. 10 shows a cross-sectional view taken on line B2—B2 of FIG. 9.

As shown in FIGS. 9 and 10, when the oil under pressure is supplied to the concave portion 20*c* via an oil passage 26*a* as an arrow Y1, the plate member 27 is moved rightward and the circle hole of the plate member 27 and the circular groove 21 are coaxial with each other so that the holding member 20 can move relative to the cylinder head 50. As a result, the holding member 20 and the arm shaft 12 move downward and the first rocker arm 11 is oscillated around the fulcrum member 45 as shown in FIG. 7.

Under this condition, the distance R1 between the fulcrum (the fulcrum member 45) and the contacting point S*c* of the second rocker arm 15 (or the first rocker arm 11) in contact with the second cam 42 (or the first cam 41) becomes larger than the distance R2 (FIG. 6) as shown in FIG. 7. On the other hand, the distance between the contacting point S*p* and the contacting point S*c* is not changed. As a result, the swing stroke of the contacting point S*p* of the first rocker arm 11 becomes small.

Figure 11:
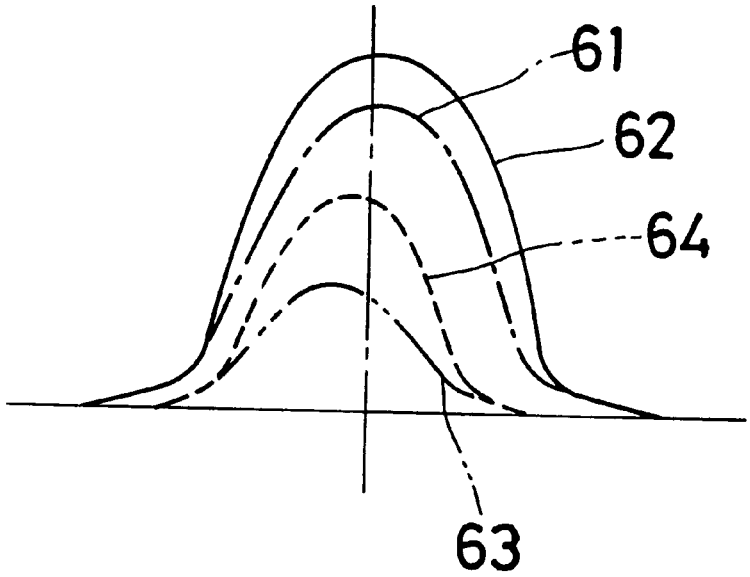
FIG. 11 shows a lift characteristic curve of a first embodiment of a valve control device in accordance with the present invention.

As mentioned above, according to the first embodiment, as shown in FIG. 11, the valve control device obtains four lift characteristics 61, 62, 63, 64 by controlling the moving means 20 and the release means 30. Namely, when the holding member 20 is not movable relative to the cylinder head 50 and that the connection between the first and second rocker arms 11, 15 is not released, the lift characteristic 61 is obtained. When the holding member 20 is in a movable condition relative to the cylinder head 50 and the connection between the first and second rocker arms 11, 15 is not released, the lift characteristic 62 is obtained. When the holding member 20 is not movable relative to the cylinder head 50 and that the connection between the first and second rocker arms 11, 15 is released, the lift characteristic 64 is obtained. Further, when the holding member 20 is in a movable condition relative to the cylinder head 50 and the connection between the first and second rocker arms 11, 15 is released, the lift characteristic 63 is obtained.

The characteristic 63 is used for the idling condition of the engine so as to decrease the friction of the valve mechanism, and the characteristics 61, 64 are used for the middle load condition of the engine as an optimal lift characteristic. Further, the characteristic 62 is used for the high load condition of the engine as an optimal lift characteristic. Thereby, the power of the engine becoming discontinuous at the transition of the lift characteristic can be avoided, and the power of the engine is changing before and after the change of the lift characteristic can be prevented. As a result, optimal lift characteristics in response to the running condition of the engine while simultaneously saving fuel can be achieved. Further, these excellent effects are obtained without complicating the structure or increasing the size of the valve control device.

Figure 13:
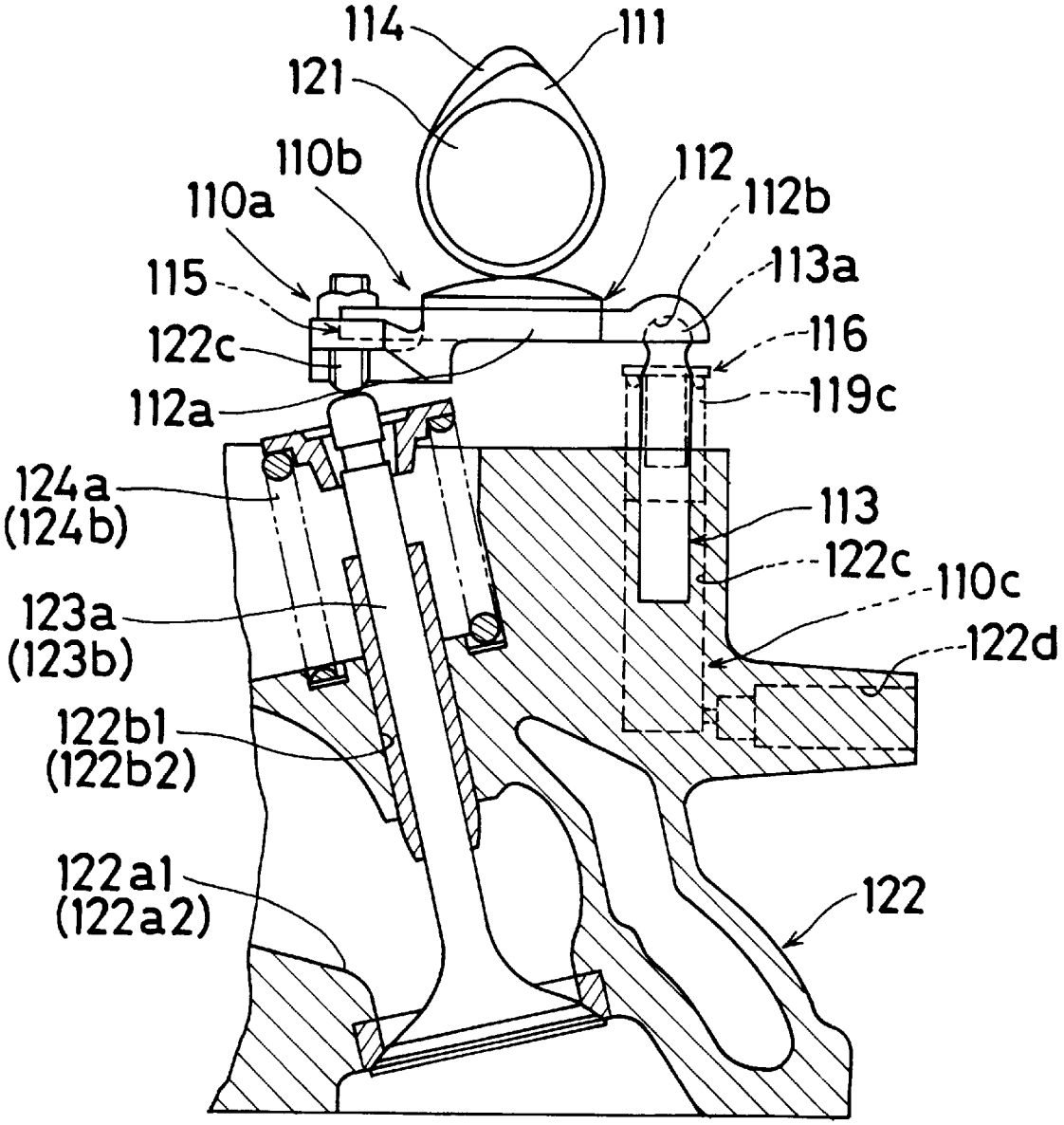
FIG. 13 shows a partly sectional view of a second embodiment of a valve control device in accordance with the present invention.
Figure 14:
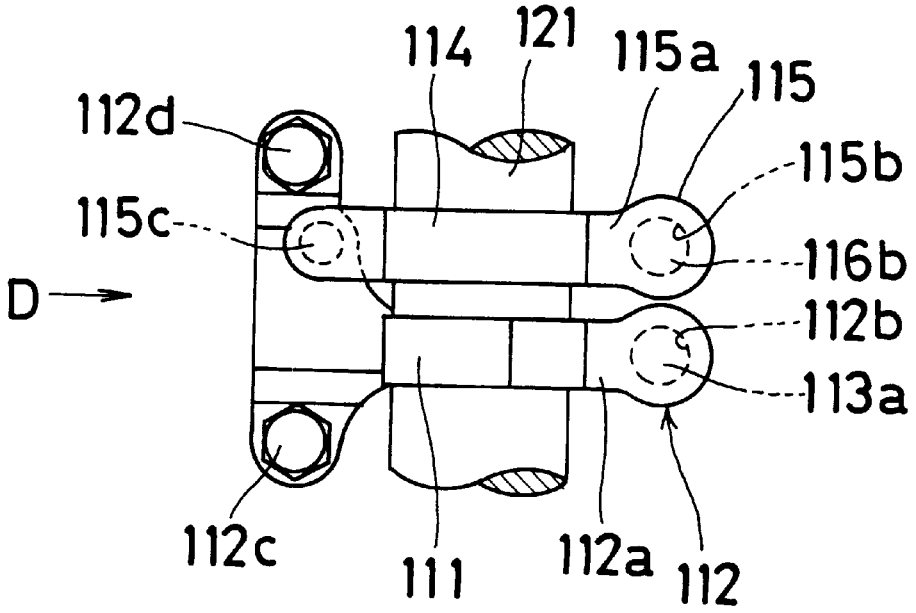
FIG. 14 shows a plan view of the first and second rocker arms in FIG. 13.
Figure 15:
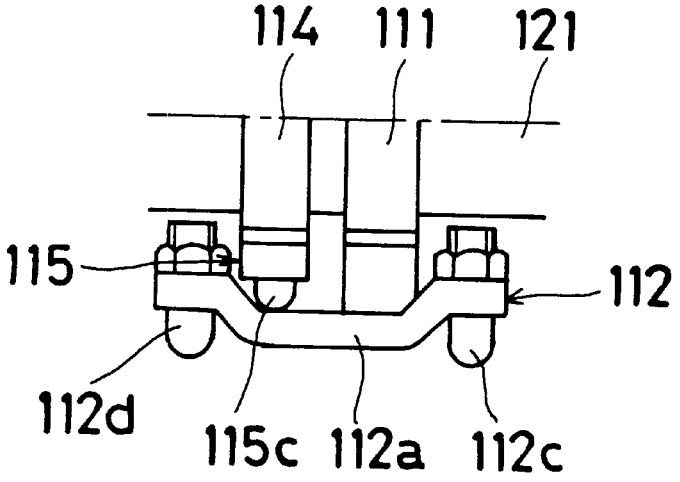
FIG. 15 shows a side view as seen from a direction indicated by an arrow D of FIG. 14.
Figure 16:
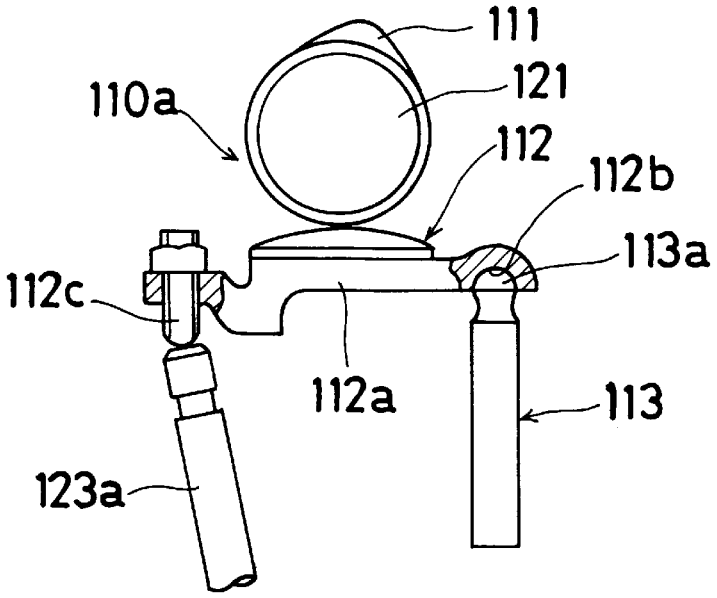
FIG. 16 shows a partly sectional view of a low lift drive mechanism of a second embodiment of a valve control device in accordance with the present invention.
Figure 17:
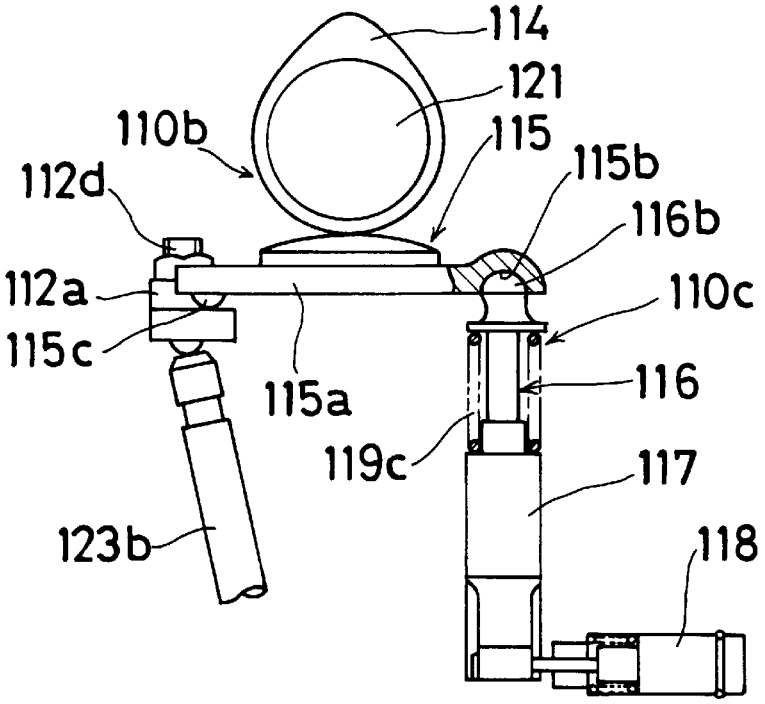
FIG. 17 shows a partly sectional view of a high lift drive mechanism of a second embodiment of a valve control device in accordance with the present invention.

Referring first to FIG. 13, there is illustrated a second embodiment of a valve control device for an internal combustion engine according to the present invention. The valve control device, which is designed for opening and closing a pair of intake (or exhaust) valves 123*a* and 123*b*, has a low lift drive mechanism 110*a*, a high lift drive mechanism 110*b*, and a hydraulic pressure lifter 110*c* which is a principal element of the high lift drive mechanism 110*b*. It is to be noted that this valve control device can be used, without any change or modification, for opening and closing a pair of exhaust valves (not shown).

As shown in FIGS. 13 through 17, the low lift drive mechanism 110*a* includes a low lift cam 111 fixedly mounted on a cam shaft 121 and a first rocker arm 112.

The first rocker arm 112 has a main portion 112*a* which is of a substantially T-shaped configuration in plain view. A proximal end portion (right end portion in FIG. 14) of the main portion 112*a* is formed with a semi-spherical bore 112*b* opening downwardly. A distal end portion (left end portion in FIG. 14) of the main portion 112*a* which is said to be a swing side thereof is driven with a pair of adjusting screws 112*c* and 112*d*. A pole 113 which is connected to a cylinder head 122 and extends in the upward direction. A top end portion 113*a* of the pole 113 is formed into a semi-spherical configuration and is fitted into the bore 112*b* of the main portion 112*a*, resulting in that the proximal end portion of the main portion 112*a* being supported on the cylinder head 122 by means of the upstanding pole 113. The adjusting screws 112*c* and 112*d* are in abutment on top portions of the intake valves 123*a* and 123*b*, respectively. A profile of the low lift cam 111 shows it in sliding engagement with an outer surface of the main portion 112*a* of the low lift arm 112.

The intake valve 123*a* for opening and closing an intake opening 122*a*1 passes through an elongated narrow opening 122*b*1 formed in the cylinder head 122 and is urged by a valve Spring 124*a* in the upward direction, thereby being engaged elastically with the adjusting screw 112*c* connected to the first rocker arm 112, while the intake valve 123*b* for opening and closing another intake opening 122*a*2 passes through an elongated narrow opening 122*b*2 formed in the cylinder head 122 and is urged by a valve spring 124*b* in the upward direction, thereby being engaged elastically with the adjusting screw 112*d* connected to the first rocker arm 112.

In the low lift drive mechanism 110*a*, the first rocker 112 is brought into vertical swing movement about the top portion 113*a* of the pole 113 due to an action of the low lift cam 111 which is in unitary rotation with the cam shaft 121, thereby establishing reciprocal movement of the intake valves 123*a* and 123*b*. Thus, opening and closing each of the opening 122*a*1 and 122*a*2 is established.

The high lift drive mechanism 110*b* has, as shown in FIGS. 13, 14, 15, and 17, a high lift cam 114 which is fixedly mounted on the cam shaft 121, a second rocker arm 115, and the hydraulic pressure lifter 110*c*. The high rocker arm 115 has a main portion 115*a* which is formed into an I-shaped configuration in plain view. The main portion 115*a* is provided at its proximal (right) end portion and distal (left) end portion with a semi-spherical concave portion 115*b* and a downwardly oriented projection 115*c*, respectively. The hydraulic pressure lifter 110*c* is fitted in the cylinder head 122 and has an upstanding movable or extensible pole 116 whose top end portion 116*b* is formed into semispherical projection. The top end portion 116*b* of the hydraulic pressure lifter 110*c* is fitted in the proximal end portion 115*b* of the high rocker arm 115.

The second rocker arm 115 is in abutment with a profile of the high lift cam 14. The projection 115*c* formed at the distal end portion of the high rocker arm 115 is in abutment with the distal end portion of the main portion 112& of the first rocker arm 112. The resultant abutment position relative to the high lift cam 114 is nearer than a position of the adjusting screw 112 (112*d*) relative to the high lift cam 114.

In the high lift drive cam mechanism 110*b*, due to the rotation of the high lift cam 114 when it is in unitary rotation with the cam shaft 121, the second rocker arm 112 is brought into a vertical swing movement about the top end portion 116*b* of the pole 116, resulting in vertical movements of the intake valves 123*a* and 123*b*. Thus, opening and closing each of the intake openings 122*a*1 and 122*a*2 is established. It is to be noted that the profile of the high lift cam 114 is set to be larger than that of the low lift cam 111 in radius for enabling that a swing movement degree of the second rocker arm 115 is larger than that of the first rocker arm 112 upon rotation of the cam shaft 121.

Figure 18:
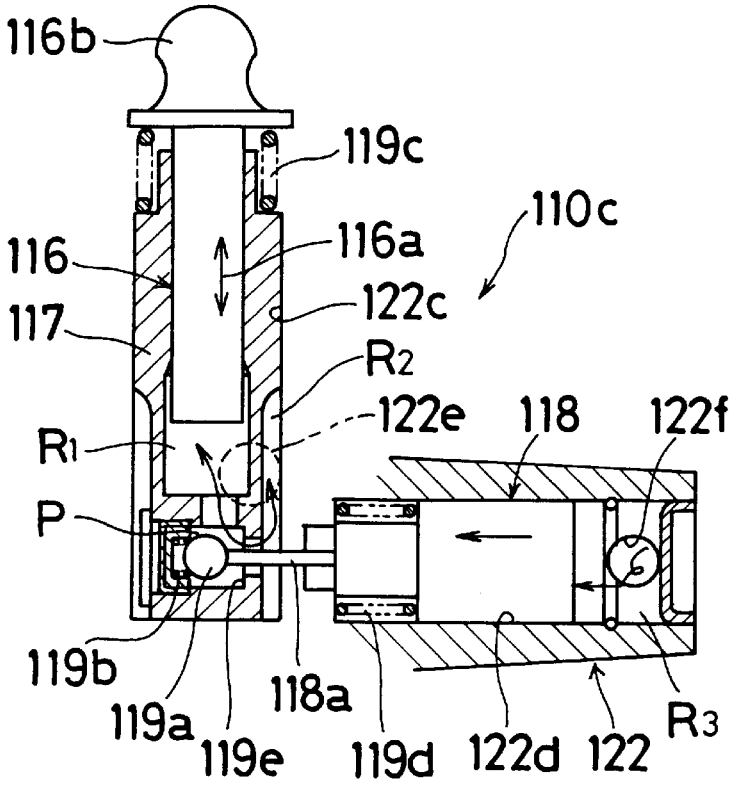
FIG. 18 shows a sectional view of a hydraulic pressure lifter of a second embodiment under which the operation of the second rocker arm is regulated.
Figure 20:
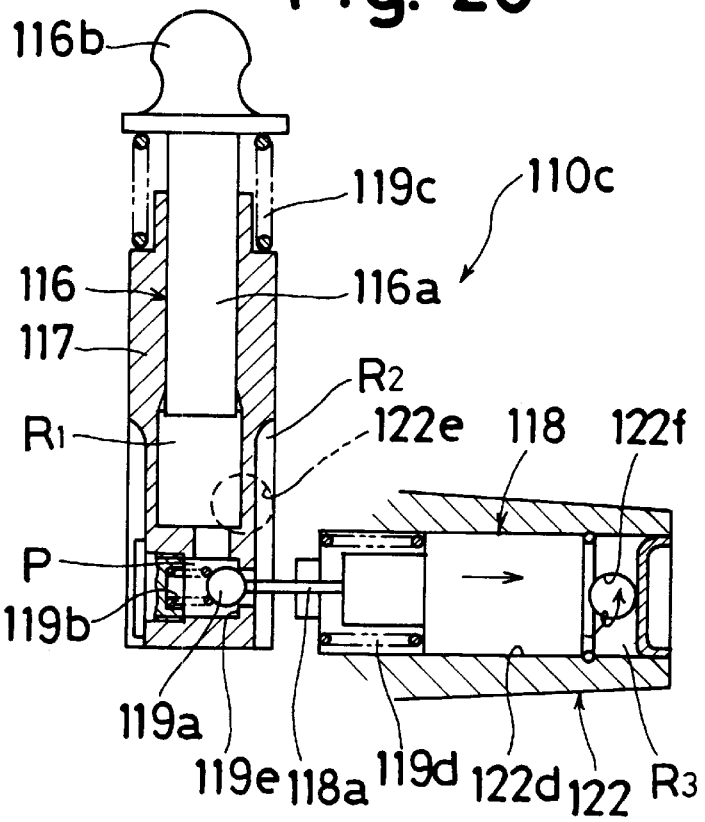
FIG. 20 shows a sectional view of a hydraulic pressure after of a second embodiment under which the operation of the second rocker arm is not regulated.

As best shown in FIGS. 18 and 20, the hydraulic pressure lifter 110*c* includes the extensible pole 116, a casing 117, accommodating therein the pole 116 and fitted in a bore 122*c* of the cylinder head 122, and a plunger 118 fitted in a bore 122*d* whose axis is perpendicular to that of the bore 122*c*. In addition, the hydraulic pressure lifter 110*c* further includes a check ball 119*a*, a spring 119*b* urging the check ball 119*a*, and a spring 119*c* urging the pole 116 in the upward direction.

A pressure chamber R1 is defined between the casing 117 and the pole 116 under an upward urging by the spring 119*c*. A reservoir chamber R2 is defined between an outer out portion of the casing 117 and the cylinder head 122. Between both the pressure chambers R1 and R2, there is interposed the check ball 119*a*. The check ball 119*a* is made to be engaged with a valve seat 119*c* by an urging of the spring 119*b*, thereby closing a passage P. It is to be noted that the pressure chamber R1 is supplied with an oil through a supply port 122*e* formed in the cylinder head 122.

At a rear side of the plunger 118, there is defined an oil chamber R3 in the bore 122*d*. The plunger 118 is urged toward the oil chamber R3 by a spring 119*d* which is positioned at a front side of the bore 122*d*. The plunger 118 is provided at its distal end thereof with a rod 118*a* which is in abutment with the check ball 119*a* urged by the spring 119*b* after passing through the reservoir chamber R2. A passage 122*f* is formed in the cylinder head 122 for supplying and draining an oil to and from the oil chamber R3.

Normally, in the hydraulic pressure lifter 110*c*, the oil chamber R3 is supplied in full with the oil, and the plunger 118 is at a position as shown, in FIG. 18 moves the check ball 119*a* away from the valve seat 119*e*, thereby establishing fluid communication between the pressure chamber R1 and the reservoir chamber R2 through the passage P. Thus, the oil under pressure can enter the reservoir chamber R2, thereby invalidating the supporting of the second rocker arm 115 by the pole 116.

Figure 19:
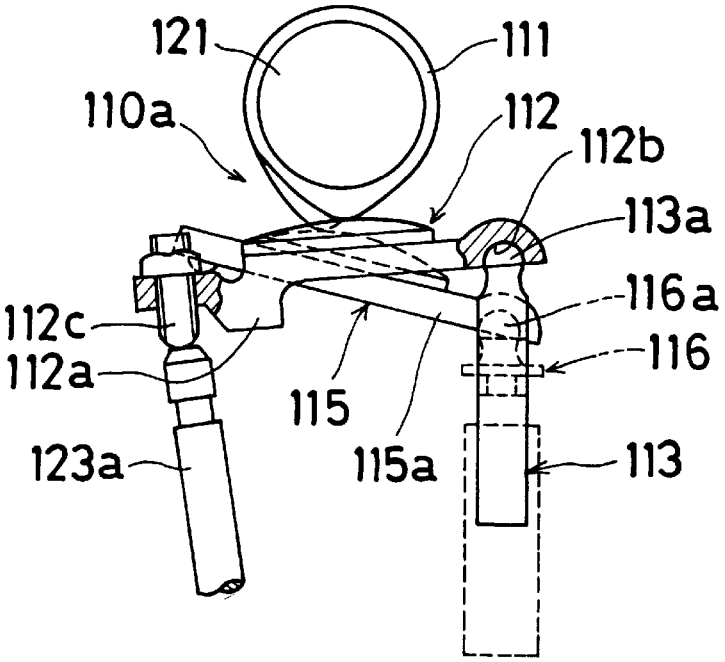
FIG. 19 shows a partly sectional view of the operational condition of the low lift drive mechanism of a second embodiment of a valve control device in accordance with the present invention.

While such a condition remains unchanged, the low lift cam 111 which is in unitary rotation with the cam shaft 121 urges the first rocker arm 112 repeatedly, thereby establishing the repetition swing movement of the rocker arm 112 about the supporting portion 113*a* which serves as the fulcrum as best shown in FIG. 19. Thus, opening and closing operations of the each of the intake valves 123*a* and 123*b* are established in a repetitious manner. During such an operation, the high lift cam 114 which is also in unitary rotation with the cam shaft 121 establishes a repeating swing movement of the second rocker arm 115. However, as depicted in the phantom line in FIG. 19, the swing movement of the high rocker arm 116 which is not supported by the pole 116, only compresses the spring 119*c* which fails to operate the intake valves 123*a* and 123*b*. Thus, a stroke of each of the intake valves 123*a* and 123*b* depends on a low lift degree or quantity determined by the rating or profile of the first rocker 112.

Under such a condition, the oil in the oil chamber R3 is drained, the plunger 118 is retracted to a position as shown in FIG. 20, the check ball 119*a* is brought onto the valve seat 119*a*, thereby interrupting the fluid communication between the pressure chamber R1 and the reservoir chamber R2. Thus, the pole 116 is raised by the pressure of the oil in the pressure chamber R1 and kept at a designated height, whereby the resulting pole 116 recovers its function to support the second rocker arm 115.

Figure 21:
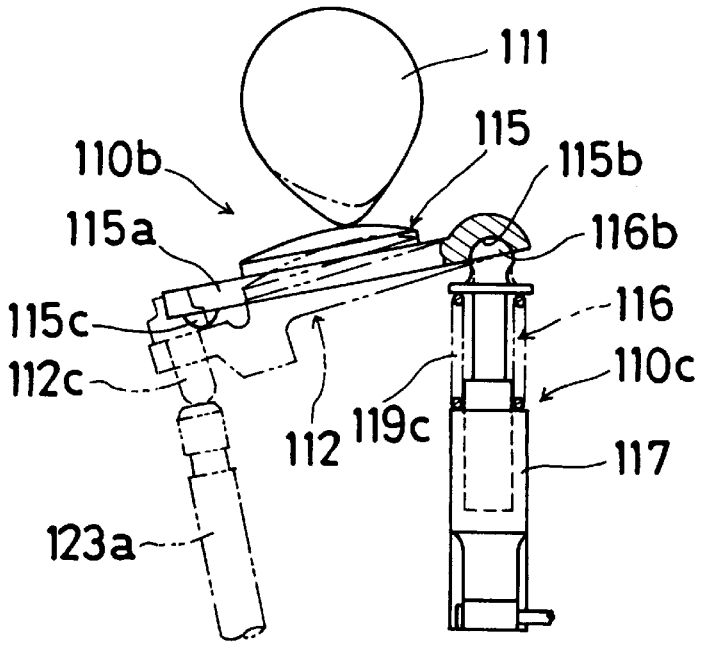
FIG. 21 shows a partly sectional view of the operational condition of the low lift drive mechanism of a second embodiment of a valve control device in accordance with the present invention.

While the resulting condition remains unchanged, the high lift cam 112 which is in unitary rotation with the cam shaft 121 establishes a repeating swing movement of the second rocker arm 115 about the top end portion 116*b* of the pole 116 which acts as a second fulcrum, as shown in FIG. 21, thereby establishing a reciprocal movement of each of the intake valves 123*a* and 123*b* in repeating manner. Since the profile of the high lift cam 112 is larger than that of the low lift cam 111 in radius as previously mentioned, the swing movement caused by the low lift cam 111 is included in the movement caused by the high lift cam 112. Thus, a stroke of each of the intake valves 123*a* and 123*b* depends on a high lift degree or quantity determined by the rating or profile of the second rocker arm 113.

In the valve control device having the aforementioned structure, at an initial stage of the internal combustion engine operation, the low lift drive mechanism 110*a* is driven, and thereafter as a consequence of an increase in the number of rotations of the engine and/or an increase in the load of the engine, the high lift drive mechanism 110*b* and the low lift drive mechanism 110*a* are brought into operation and termination, respectively, simultaneously. Such a selection of either the low lift drive mechanism 110*a* or the high lift drive mechanism 110*b* depending on engine operation condition, which causes a change in the intake valves from the high condition to the low condition and vice-versa. Thus, an increase in the output of the engine, a lowering in the consumption of fuel, and an improvement in idling characteristics all become possible.

In the valve control device as mentioned above, driving the low lift drive mechanism 110*a* instead of the high lift drive mechanism 11*b* can be established only by invalidating the support function of the pole 116 which supports the high rocker arm 115 as a main element of the high lift drive mechanism 110*b*. Bringing the pole 116 into its invalidation condition, an mentioned above, can be established only by draining the oil pressure applied to the high lift cam. Such a drain can be established easily. Thus, the valve control device, in spite of having the foregoing functions, can be of simple construction which is easy to assemble.

In addition, since each of the rocker arms 112 and 115 is not required to be modified by adding another element having a large mass, the mass of each rocker arm remains unchanged as conventional. Thus, each rocker arm can operate without any bad condition.

The principles, preferred embodiments and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A valve control device for an internal combustion engine comprising:

a rotational cam shaft disposed on a cylinder head;

a first cam provided on the cam shaft;

a second cam provided on the cam shaft and having a larger nose portion than that of the first cam;

a first rocker arm supported on a first fulcrum so as to be able to oscillate, a swing end of the first rocker arm being in contact with an intake or exhaust valve at a first contact point, and the first rocker arm being oscillated for opening and closing the intake or exhaust valve by the first cam in response to the rotation of the cam shaft;

a second rocker arm supported on a second fulcrum so as to be able to oscillate, a swing end of the second rocker arm being operatively connected to the first rocker arm at a connection point, the second rocker arm being oscillated for opening and closing the intake or exhaust valve by the second cam in response to the rotation of the cam shaft; and moving means for selectively moving the second fulcrum so as to control the opening and closing operation of the intake or exhaust valve by the second rocker arm, wherein the moving means includes an engaging member for engaging and disengaging between the first rocker arm and the second rocker arm.

2. A valve control device for an internal combustion engine recited in claim 1, wherein the moving means includes hydraulic pressure lifter having a lost motion function.

3. A valve control device for an internal combustion engine recited in claim 2, wherein said connection point between the first and second rocker arms is located on the first rocker arm between the first contact point of said fist rocker arm with the intake or exhaust valve and a second contacting point of said first rocker arm with the first cam.

4. A valve control device for an internal combustion engine comprising:

a rotational cam shaft disposed on a cylinder head;

a first cam provided on the cam shaft;

a second cam provided on the cam shaft and having a larger nose portion than that of the first cam;

a first rocker arm supported on a first fulcrum so as to be able to oscillate, a swing end of the first rocker arm being in contact with an intake or exhaust valve at a first contact point, and the first rocker arm being oscillated for opening and closing the intake or exhaust valve by the first cam in response to the rotation of the cam shaft;

a second rocker arm supported on a second fulcrum so as to be able to oscillate, a swing end of the second rocker arm being operatively connected to the first rocker arm at a connection point, and the second rocker arm being oscillated for opening and closing the intake or exhaust valve by the second cam in response to the rotation of the cam shaft; and moving means for selectively moving the first fulcrum so as to control the opening and closing operation of the intake or exhaust valve by the first rocker arm, the second fulcrum so as to control the opening and closing operation of the intake or exhaust valve by the second rocker arm, and a third fulcrum supporting the first rocker arm so as to oscillate when the first fulcrum is moved, wherein the third fulcrum is farther separated from the swing end of the first rocker arm than the first fulcrum.

5. A valve control device for an internal combustion engine recited in claim 4, further comprising release means for selectively releasing the connection between the first and second rocker arms.

6. A valve control device for an internal combustion engine recited in claim 4, wherein the first and second fulcrum is a common sliding member which is slidably fitted into a hole formed on the cylinder head, and the moving means includes a concave portion formed in the hole, a groove formed on the sliding member and an engaging member which is able to engage with the concave portion and the groove, and wherein the sliding member is slidable relative to the cylinder head when the engaging member is not engaged with the groove and the sliding member is not slidable relative to the cylinder head when the engaging member is engaged with the groove and the concave portion.

7. A valve control device for an internal combustion engine recited in claim 5, wherein the release means includes holes which are formed in the first and second rocker arms so as to be coaxial with each other when the relative position between the first and second rocker arms is in a predetermined position and a connecting member which is fitted into one of the holes and which is selectively fitted into the other of holes while fitting into one of the holes.

* * * * *